United States Patent [19]

Shee

[11] Patent Number: 4,721,204

[45] Date of Patent: Jan. 26, 1988

[54] PACKAGE FOR HOLDING AND USING AMPULES

[76] Inventor: William S. Shee, 101 N. Racebrook Rd., Woodbridge, Conn. 06525

[21] Appl. No.: 37

[22] Filed: Jan. 2, 1987

[51] Int. Cl.[4] ..... B65D 85/42; B65D 83/04

[52] U.S. Cl. ..... 206/210; 206/229; 206/528; 206/470

[58] Field of Search ..... 206/210, 229, 361, 534.1, 206/534.2, 532, 530, 538, 438, 470, 461, 467, 485, 828, 477, 478, 483, 490

[56] References Cited

U.S. PATENT DOCUMENTS

| | | | |
|---|---|---|---|
| 1,980,141 | 11/1934 | MacGregor | 206/229 |
| 2,335,015 | 11/1943 | Lantheaume | 206/438 X |
| 2,497,950 | 2/1950 | Lohr et al. | 206/229 X |
| 3,174,621 | 3/1965 | Watson | 206/470 |
| 3,640,437 | 2/1972 | Galy | 206/538 X |
| 4,211,323 | 7/1980 | Olsen | 206/210 |
| 4,373,631 | 2/1983 | Friese et al. | 206/438 |
| 4,437,566 | 3/1984 | Szahler | 206/467 X |
| 4,667,826 | 5/1987 | Salacuse | 206/461 |

*Primary Examiner*—George E. Lowrance
*Assistant Examiner*—Tracy Graveline
*Attorney, Agent, or Firm*—Thomas L. Tully; Martey R. Perman; Clarence A. Green

[57] ABSTRACT

A package for containing, dispensing and employing a plurality of conventional prep swab ampules comprising liquid-containing breakable glass capsules within protective plastic sheaths or vials capped with swab tips. The package comprises a multi-ampule closed compartment for holding and dispensing a plurality of ampules as required, and a flexible, open-ended sleeve associated therewith. The sleeve is designed to receive and frictionally-engage each dispensed ampule, to permit the breaking of the inner vial while further protecting the fingers and, if desired, to permit the use of the broken ampule for its intended purpose while it remains frictionally-engaged within the sleeve on the package.

8 Claims, 2 Drawing Figures

PACKAGE FOR HOLDING AND USING AMPULES

BACKGROUND OF THE INVENTION

The present invention relates to novel containers for holding, dispensing and using a plurality of conventional crushable ampules comprising liquid-filled, breakable glass capsules, such as prep swab ampules containing tincture of iodine or similar antiseptic medication, or containing resin-curing catalyst or any other flowable liquid which is isolated within a sealed breakable vial against contamination, evaporation or other effects of exposure.

Conventional prep swab ampules comprise an interior breakable sealed glass capsule containing the flowable liquid, such as iodine, an outer protective sheath or vial of thin flexible plastic film, such as polyvinyl chloride or cellulose acetate, which is sealed at one end and closed or capped at the other end by a liquid-permeable swab tip similar to a cigarette filter. The purpose of the sheath is to permit compression between the fingers to break the glass capsule and release the liquid while protecting the fingers against being cut by the broken glass, and to contain the released liquid so that it can only be released through the permeable swab tip for application to a desired surface, such as the skin.

In the medical field, such ampules are generally purchased in bulk quantities, and numbers of such individual ampules, with exposed swab tips, may be carried by nurses, doctors or other medical technicians in pockets, hands or on trays where they are exposed to contamination and premature breakage. Also, it is possible for such frequent users to be cut on the fingers while breaking and/or using the glass ampules because the glass is very thin and sharp and since the protective plastic sheath or vial is also thin, much softer than glass and susceptible to cracking and/or being cut and pierced by the broken glass. Moreover, since the ampules are small, usually less than two inches long and about one-quarter inch in diameter, they are difficult for some users to hold between the fingers during end use, and such use requires the fingers of the user to be brought into close proximity with the surface being treated. This is particularly dangerous in cases where the user's fingers may have been cut by the broken capsule and the surface being treated is an open wound or catherer entry site.

SUMMARY OF THE INVENTION

The present invention relates to a novel container for a convenient plurality of conventional crushable prep swab ampules, such as about ten in number, and for dispensing such ampules one at a time as required, and for holding each ampule during crushing of the glass capsule thereof to further protect the fingers of the user and, if desired, for holding the active ampule during the end use thereof.

The novel containers of the invention comprise a closed multi-ampule compartment, a closure means thereon for permitting the dispensing or removal of the ampules, individually as required, and a flexible, open-ended sleeve supported thereon and designed to receive and frictionally-engage each ampule during activation and, if desired, during use after activation, thereby providing the user with further protection against cutting and, if desired, providing increased convenience, simplicity and safety during use.

DETAILED DESCRIPTION

Figure 1:
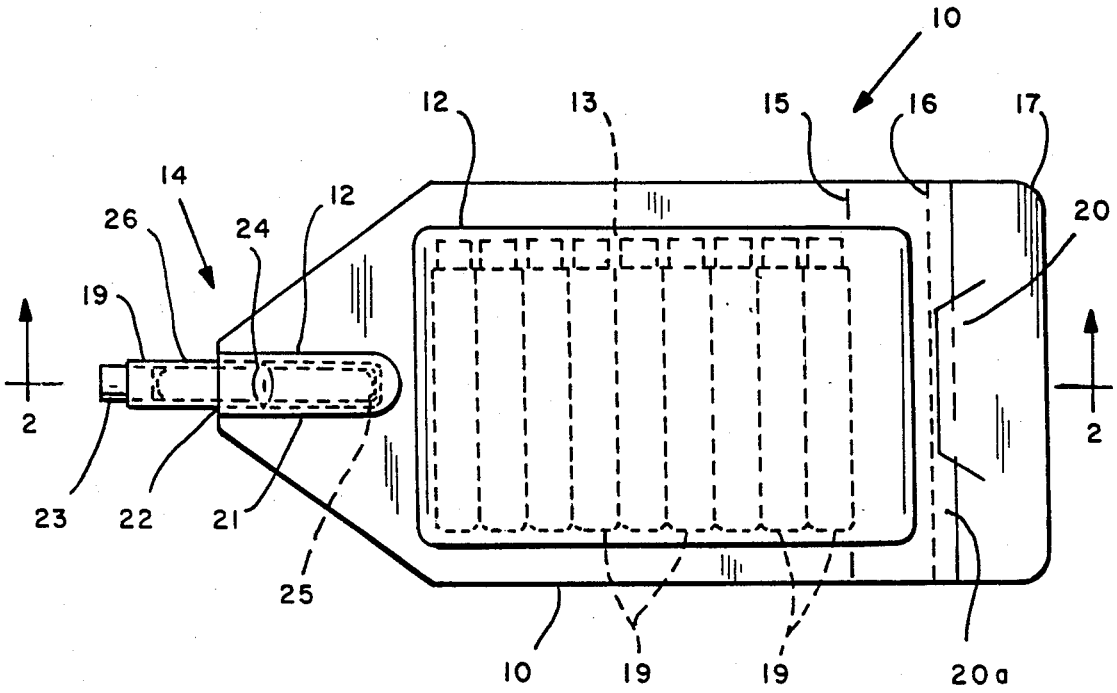
FIG. 1 is a plan view of a novel package for holding and using prep swab-type ampules, according to one embodiment of the present invention.

Referring to the drawing, the ampule package 10 thereof is a blister package comprising an elongate rigid cardboard backing or support element 11 to which is attached a flexible, clear plastic blister element 12 which is premolded to comprise, in association with the support element 11, a multi-ampule container compartment 13 and an individual ampule holder section 14.

Figure 2:
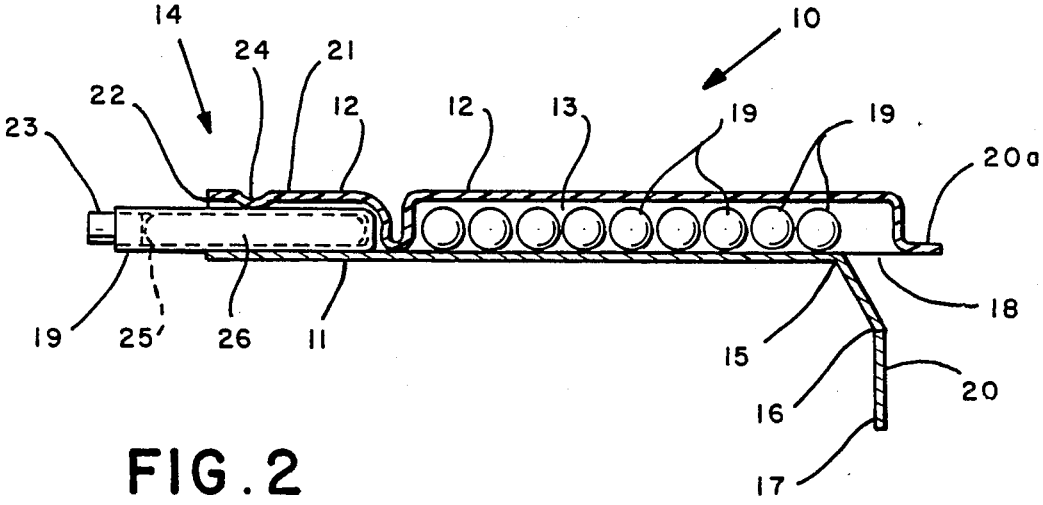
FIG. 2 is a view taken along the line 2—2 of FIG. 1 but further illustrating the flap closure means in open position for the dispensing of an ampule.

The support element 11 is preformed with transverse fold lines 15 and 16 to provide an end flap 17 which either is not laminated or adhered to the blister element 12 or is separable therefrom when the package is initially opened, back to the fold line 15, a point inwardly of the end of the multi-ampule container compartment 13, to permit the flap 17 to be folded down, along fold line 15, to provide a transverse opening 18 in compartment 13 which is slightly wider than the width of each of the ampules 19 present in the compartment 13, as shown most clearly by FIG. 2. In the embodiment of FIGS. 1 and 2, the end flap 17 is also cut inwardly from fold line 16 to form a tongue closure means 20 which is positioned to overlap the opposed free end **20*a* of the blister element 12 when the flap is folded flat thereagainst, as shown by FIG. 1. Fold line 16 permits the flap 17 to be flexed therealong to open the tongue closure means 20 for positioning over the free end 20*a* of the blister element 12 to close the access opening 18 after the removal of each of the ampules 19 and reseal the compartment 13**.

FIGS. 1 and 2 also illustrate the presence of an ampule 19 within the holder section 14 of the blister element 12. The holder section 14 comprises an integral molded plastic sleeve 21 which, in association with the backing 11, forms an open-ended tube having a diameter slightly greater than the diameter of the ampules 19, a length of from about 50% to about 90% of the length of the ampule 19, and an opening 22 to receive the ampule 19 in a longitudinal position such that the swab tip 23 thereof faces away from the container 10. The plastic sleeve 21 preferably is provided with a transverse depression 24 molded into the upper portion thereof, adjacent the opening 22. The depression 24 provides a flexible or yieldable restriction in the width or diameter of the sleeve 21 so that an inserted ampule 19 is frictionally-engaged thereby and is prevented from slipping out of the sleeve 21 when the package 10 is inverted during use.

The depression 24 preferably is located at a point intermediate the length of the liquid-containing glass capsule 25 of each ampule 10 seated within the sleeve 21, to provide a pressure-application location for the person using the ampule holder section 14

The ampule holder section 14 of the package 10 is designed to serve two important functions. Although each conventional medicinal ampule 19 comprises a flexible molded plastic tube or vial 26, adhered to the porous swab tip 23 and containing the breakable, liquid-containing glass capsule 25, the plastic vial 26 can be pierced by the glass capsule 25 during breakage and can cut the fingers under the effects of the applied pressure. This possibility is substantially reduced by the presence of the flexible plastic sleeve 21 of the ampule holder section 14 as another interposed protective plastic layer between the fingers and the broken glass capsule 25 during the breakage step.

A second important advantage of the ampule holder section 14 is that it converts the package 10 to a convenient, easily held application device when an activated ampule 19 is present within the sleeve 21. Thus, the package 10 can be held by the user in the same manner as a knife or a pencil, with hand-holding pressure exerted in the area of the ampule container compartment 13, to apply the liquid-impregnated swab tip 23 to the wound or other body area. This spaces the hand of the user from the wound or other area during application, for increased safety.

The ampule holder package illustrated by the drawing comprises a cardboard support and a blister pack molded from a cellulose ester film such as cellulose acetate propionate having a thickness of about 3 mils. Other conventional blister pack-forming films are also suitable, including polyvinyl chloride, polypropylene, chlorinated rubber, and the like. The film caliper may be varied, between about 2.5 and 10 mils. Laminates of different plastic films may also be used, as may oriented films or laminates of films oriented in different directions, for increased strength and resistance to cracking during repeated crushing operations.

It will be apparent to those skilled in the art in the light of the present disclosure that the present multi-ampule container and holder packages can be formed with designs and compositions other than the one illustrated by the present drawing. For example, the package can consist of a cardboard or molded rigid plastic multi-ampule compartment having a closure flap, lid or cover, and an attached flexible plastic ampule holder section 12 for breakage purposes. The latter may be mounted on the outside of the container compartment, or may be hingeably-attached for storage within the compartment and used in an exterior position, or may be contained within or adjacent the compartment 13 with the sleeve opening 22 external thereto, provided that the compartment 13 is formed of compressible material if the holder sleeve 21 is contained therewithin.

Variations and modifications of the present invention will be apparent to those skilled in the art within the scope of the present claims.

Having thus described the invention, what is claimed is:

1. A package for containing a plurality of breakable liquid-containing glass ampules and for holding said ampules, individually, during the breakage thereof, said package comprising a closed compartment designed to contain a plurality of identical prep swab ampules, each comprising a breakable glass capsule containing a liquid, a flexible plastic vial enclosing said capsule and a swab tip capping said vial and being penetrable by said liquid when said glass capsule is broken, said compartment including reclosable means for the removal of individual ampules therefrom, said package also comprising an integral, flexible sleeve means for receiving and holding said ampules, individually, to permit finger pressure to be applied through said sleeve means and through said plastic vial to break the glass capsule of the ampule, to provide additional protection of the fingers against the penetration of glass from each said ampule during the breaking of the glass capsule thereof.

2. A package according to claim 1 in which said sleeve means comprises an open-ended tube comprising a flexible plastic wall, said tube having a diameter slightly larger than the diameter of the individual ampules and being provided with interior holding means for frictionally-engaging an ampule inserted therewithin.

3. A package according to claim 2 in which said holding means comprises a depression formed in the flexible plastic wall of said open-ended tube.

4. A package according to claim 1 comprising an elongate, rigid support to which are attached said ampule compartment and said sleeve means.

5. A package according to claim 4 in which said ampule compartment and said sleeve means are molded from one or more layers of flexible plastic film.

6. A package according to claim 5 in which said layer of flexible plastic film comprises a blister sheet which is attached to the rigid support to form, in association therewith, said ampule compartment and said sleeve means.

7. A package according to claim 4 in which the rigid support is provided with a transverse folding means in an area underlying the ampule compartment to provide the reclosable means for the removal of ampules from said compartment.

8. A package according to claim 1 in which said sleeve means is attached to an end of said elongate support to extend longitudinally thereof and to hold an ampule with its swab tip facing away from said package, whereby the package can serve as a holder of the ampule during application of the liquid.

* * * * *